US008841799B2

(12) United States Patent
Yamkovoy et al.

(10) Patent No.: US 8,841,799 B2
(45) **Date of Patent: *Sep. 23, 2014**

(54) ZERO POWER DRAIN PUSHBUTTON CONTROLS

(75) Inventors: Paul G. Yamkovoy, Acton, MA (US); Benjamin D. Burge, Shaker Heights, OH (US)

(73) Assignee: Bose Corporation, Framingham, MA (US)

( * ) Notice: Subject to any disclaimer, the term of this patent is extended or adjusted under 35 U.S.C. 154(b) by 805 days.

This patent is subject to a terminal disclaimer.

(21) Appl. No.: 13/080,357

(22) Filed: Apr. 5, 2011

(65) Prior Publication Data

US 2011/0227631 A1 Sep. 22, 2011

Related U.S. Application Data

(63) Continuation-in-part of application No. 12/838,479, filed on Jul. 18, 2010, now Pat. No. 8,432,068, which is a continuation-in-part of application No. 12/431,959, filed on Apr. 29, 2009, now Pat. No. 8,222,641, and a continuation-in-part of application No. 12/431,962, filed on Apr. 29, 2009, now Pat. No. 8,213,625.

(51) Int. Cl.
*H04R 5/033* (2006.01)

(52) U.S. Cl.
CPC ..... *H04R 5/033* (2013.01); *H04R 2201/107* (2013.01); *H04R 2420/01* (2013.01); *H04R 2420/07* (2013.01)
USPC ..... 307/134; 307/126; 307/141; 307/141.4

(58) Field of Classification Search
CPC ..... H04R 5/033; H04R 2420/07; H04R 2201/107
USPC ..... 307/134
See application file for complete search history.

(56) References Cited

U.S. PATENT DOCUMENTS

| | | | | |
|---|---|---|---|---|
| 4,941,187 | A | 7/1990 | Slater | |
| 5,058,155 | A | 10/1991 | Larsen | |
| 6,388,343 | B1 * | 5/2002 | Michigami et al. | 307/112 |
| 7,668,308 | B1 | 2/2010 | Wurtz | |
| 2007/0225035 | A1 | 9/2007 | Gauger et al. | |
| 2007/0235754 | A1 * | 10/2007 | Yamamoto | 257/124 |
| 2008/0175402 | A1 | 7/2008 | Abe et al. | |

FOREIGN PATENT DOCUMENTS

WO 2008028175 A2 3/2008

OTHER PUBLICATIONS

Invitation to Pay Additional Fees dated Jul. 22, 2010 for Int. Appln. No. PCT/US2010/032721.
International Search Report and Written Opinion dated Dec. 13, 2010 for Int. Appln. No. PCT/US2010/032721.

* cited by examiner

*Primary Examiner* — Rexford Barnie
*Assistant Examiner* — Toan Vu

(57) ABSTRACT

A plurality of normally-open pushbutton switches are coupled to and cooperate with a pair of MOSFETs to provide each pushbutton switch of the plurality of pushbutton switches with a power on switch function for a personal audio device that does not require power to be drawn from a power source to monitor each of the pushbutton switches or to identify which of the pushbutton switches was manually operated to power on the personal audio device while awaiting operation of one of the pushbutton switches to cause the personal audio device to be powered on.

7 Claims, 8 Drawing Sheets

ZERO POWER DRAIN PUSHBUTTON CONTROLS

CROSS-REFERENCE TO RELATED APPLICATION

The present application is a continuation-in-part of application Ser. No. 12/838,479 filed Jul. 18, 2010 by Paul G. Yamkovoy, now U.S. Pat. No. 8,432,068; which in turn is a continuation-in-part of both application Ser. No. 12/431,959 filed Apr. 29, 2009 by Paul G. Yamkovoy and David D. Pape, now U.S. Pat. No. 8,222,641, and application Ser. No. 12/431,962 filed Apr. 29, 2009 by Paul G. Yamkovoy and David D. Pape, now U.S. Pat. No. 8,213,625, the disclosures of all of which are incorporated herein by reference.

TECHNICAL FIELD

This disclosure relates to monitoring a connection between a headset and an intercom system or radio, to possible responses to the status of the intercom or radio and the connection thereto, and to conserving a headset power source.

BACKGROUND

There continues to be a desire to provide both operator convenience and conservation of power in headsets, as well as in other forms of personal audio device. Pushbutton switches continue to be more sought-after than more traditional toggle-type switches. However, difficulties have been encountered in providing a pushbutton switches that do not also require the use of a combination of electronic components that continuously drain a limited power source (e.g., a battery) of a personal audio device (e.g., a headset) during low power modes that are automatically entered into as an approach to conserving the limited power available from a limited power source.

SUMMARY

A plurality of normally-open pushbutton switches are coupled to and cooperate with a pair of MOSFETs to provide each pushbutton switch of the plurality of pushbutton switches with a power on switch function for a personal audio device that does not require power to be drawn from a power source to monitor each of the pushbutton switches or to identify which of the pushbutton switches was manually operated to power on the personal audio device while awaiting operation of one of the pushbutton switches to cause the personal audio device to be powered on.

In one aspect, an apparatus includes a plurality of normally-open manually operable switches; a first MOSFET having a first gate coupled to each switch of the plurality of switches, and a first source coupled to a high voltage potential terminal of a power source to receive electric power therefrom; a second MOSFET having a second source coupled to a low voltage potential terminal of the power source; a second drain also coupled to the first gate of the first MOSFET, and a second gate to receive electric power from the power source through at least the first source and a first drain of the first MOSFET; a controller coupled to the first drain and comprising a plurality of switch inputs, wherein each switch of the plurality of switches is coupled to a switch input of the plurality of switch inputs; and wherein closing one of the switches of the plurality of switches couples the first gate to the low potential voltage terminal of the power source, placing the first MOSFET into a conductive state, providing a high voltage potential through the first MOSFET to the second gate and to the controller, placing the second MOSFET into a conductive state, providing a low voltage potential to the first gate to latch the first and the second MOSFETs in a conductive state, and enabling the controller to latch the state of the plurality of switch inputs and to identify which one of the switches was closed.

In one aspect, a method of operating an apparatus includes waiting for a provision of electric power from a power source caused by a latching interaction of a first MOSFET and a second MOSFET triggered by one normally open switch of a plurality of switches being manually operated to be closed, and latching the state of each switch of the plurality of switches and identifying a switch that was closed to trigger the latching interaction of the first and second MOSFETs.

Other features and advantages of the invention will be apparent from the description and claims that follow.

DETAILED DESCRIPTION

What is disclosed and what is claimed herein is intended to be applicable to a wide variety of headsets, i.e., devices structured to be worn on or about a user's head in a manner in which at least one acoustic driver is positioned in the vicinity of an ear, and in which a microphone is positioned in the vicinity of the user's mouth to enable two-way audio communications. It should be noted that although specific embodiments of headsets incorporating a pair of acoustic drivers (one for each of a user's ears) are presented with some degree of detail, such presentations of specific embodiments are intended to facilitate understanding through examples, and should not be taken as limiting either the scope of disclosure or the scope of claim coverage.

It is intended that what is disclosed and what is claimed herein is applicable to headsets that also provide active noise reduction (ANR), passive noise reduction (PNR), or a combination of both. It is intended that what is disclosed and what is claimed herein is applicable to headsets structured to be connected with at least an intercom system through a wired connection, but which may be further structured to be connected to any number of additional devices through wired and/or wireless connections. It is intended that what is disclosed and what is claimed herein is applicable to headsets having physical configurations structured to be worn in the vicinity of either one or both ears of a user, including and not limited to, over-the-head headsets with either one or two earpieces, behind-the-neck headsets, two-piece headsets incorporating at least one earpiece and a physically separate microphone worn on or about the neck, as well as hats or helmets incorporating earpieces and a microphone to enable audio communication. Still other embodiments of headsets to which what is disclosed and what is claimed herein is applicable will be apparent to those skilled in the art.

Figure 1:
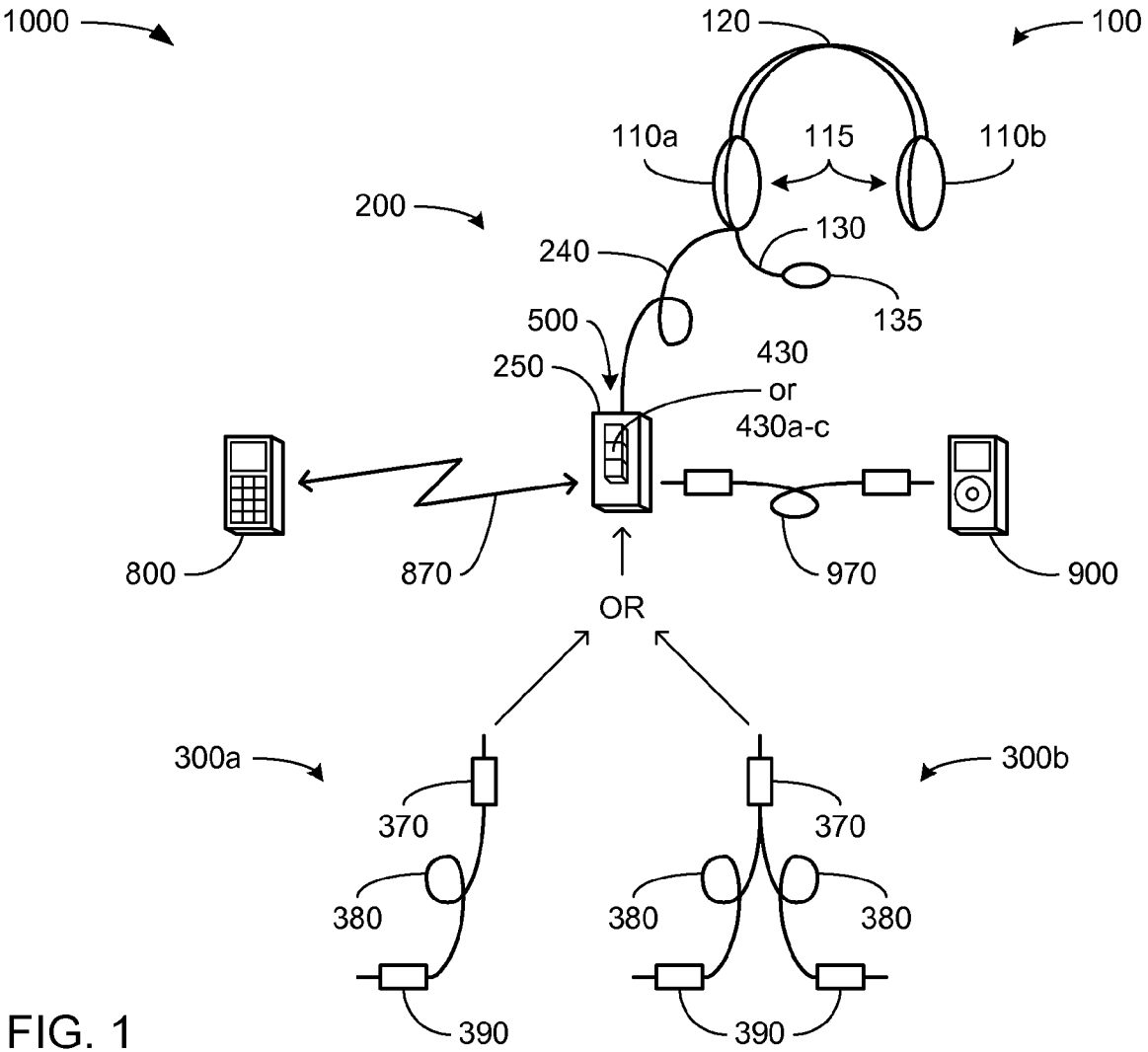
FIG. 1 is a perspective diagram of a headset.

FIG. 1 depicts an embodiment of a headset 1000 having an "over-the-head" physical configuration. The headset 1000 incorporates a head assembly 100, an upper cable assembly 200, and one or the other of a lower cable assembly 300*a* and a lower cable assembly 300*b*. The head assembly 100 incorporates a pair of earpieces 110*a* and 110*b* that each incorporate an acoustic driver 115, a headband 120 that couples together the earpieces 110*a* and 110*b*, and a microphone boom 130 extending from the earpiece 110*a* to support a communications microphone 135. The upper cable assembly 200 incorporates a control box 250 having a control circuit 500, and an electrically conductive cable 240 that couples the control box 250 to the earpiece 110*a*. The lower cable assembly 300*a* incorporates an upper coupling 370 that detachably couples the cable assembly 300*a* to the control box 250, a lower coupling 390 that detachably couples the cable assembly 300*a* to an intercom system (not shown), and an electrically conductive cable 380 that couples together the upper coupling 370 and the lower coupling 390. Similarly, the lower cable assembly 300*b* incorporates an upper coupling 370 that detachably couples the cable assembly 300*b* to the control box 250, a pair of lower couplings 390 that detachably couples the cable assembly 300*b* to an intercom system (not shown), and an electrically conductive split form of cable 380 that couples together the upper coupling 370 and the pair of lower couplings 390.

The head assembly 100 is given its over-the-head physical configuration by the headband 120. Depending on the size of each of the earpieces 110*a* and 110*b* relative to the typical size of the pinna of a human ear, each of the earpieces 110*a* and 110*b* may be either an "on-ear" (also commonly called "supra-aural") or an "around-ear" (also commonly called "circum-aural") form of earcup. As will be explained in greater detail, the provision of an acoustic driver 115 in each of the earpieces 110*a* and 110*b* enables the headset 1000 to acoustically output two-channel audio (e.g., stereo audio) to a user. The microphone boom 130 positions the communications microphone 135 is the vicinity of the mouth of a user of the headset 1000 when the head assembly 100 is correctly worn such that the earpieces 110*a* and 110*b* overly corresponding ones of the user's ears. However, despite the depiction in FIG. 1 of this particular physical configuration of the head assembly 100, those skilled in the art will readily recognize that the head assembly may take any of a variety of other physical configurations. By way of example, alternate embodiments may incorporate only one of the earpieces 110*a* and 110*b* to acoustically output only one-channel audio, may incorporate a "behind-the-head" or "behind-the-neck" variant of band in place of the headband 120, may position the communications microphone 135 on a portion of one or the other of the earpieces 110*a* and 110*b* (rather than at the end of the microphone boom 130), and/or may be structured to permit one or both of the cable 240 and the microphone boom 130 to be detachable from the earpiece 110*a* in order to be attached to the earpiece 110*b*.

The upper cable assembly 200 provides a cable-based coupling of the control box 250 the earpiece 110*a* (or possibly the earpiece 110*b*, as just discussed) through the cable 240. As will be explained in greater detail, the control circuit 500 within the control box 250 enables a user of the headset 1000 to interact with more than just an intercom system through the headset 1000. The control circuit 500 may incorporate a wireless transceiver that enables wireless communications via wireless signals 870 (e.g., infrared signals, radio frequency signals, etc.) between the control circuit 500 and a wireless device 800 (e.g., a cell-phone, an audio recording and/or playback device, a two-way radio, etc.) to thereby enable a user to interact with the wifeless device 800 through the headset 1000. The control box 250 may incorporate an auxiliary input enabling the control circuit 500 to be coupled through a cable 970 to a wired device 900 (e.g., an audio playback device, an entertainment radio, etc.) to enable a user to listen through the headset 1000 to audio provided by the wired device 900. Although not specifically depicted in FIG. 1, in various possible embodiments, the control box 250 may provide one or more manually-operable controls to enable the user to control one or more aspects of the operation of the headset 1000, possibly including coordinating the transfer of audio among the headset 1000, an intercom system to which the headset may be coupled via one or the other of the lower cable assemblies 300*a* and 300*b*, the wireless device 800 and the wired device 900. Further, and although also not depicted in FIG. 1, the control circuit 500 may be incorporated into one or both of the earpieces 110*a* and 110*b* (or some other portion of the head assembly 100) in addition to or as an alternative to being incorporated within the control box 250, thereby possibly obviating the need for the upper cable assembly 200 to incorporate the control box 250.

Each of the lower cable assemblies 300*a* and 300*b* enable the coupling of the headset 1000 to an intercom system of a vehicle or large piece of machinery, including and not limited to, a truck, multi-car train, military vehicle, airplane, seafaring vessel, crane, tunnel boring machine, harvester, combine or tractor. As previously discussed, the lower cable assembly 300*a* incorporates a single lower connector 390 for coupling to an intercom system, while the lower cable assembly 300*b* incorporates a pair of lower connectors 390. As will be readily recognized by those having familiarity with such vehicles or large pieces of machinery, despite standards that may exist in some industries, it is not uncommon for manufacturers of different ones of such vehicles or large pieces of machinery to provide intercom systems having characteristics that vary among those manufacturers. Among those varying characteristics is the separation of outgoing and incoming audio signals to be conveyed through two separate connectors by some manufacturers, while other manufacturers choose to combine both outgoing and incoming audio signals to be conveyed through a single connector. Thus, the lower cable assembly 300*a* is structured to enable the headset 1000 to be coupled to intercom systems employing a single connector through the single lower coupling 390, while the lower cable assembly 300*b* is structure to enable the headset 1000 to be coupled to intercom systems employing separate connectors through the separate ones of the pair of lower couplings 390. Although a split form of the cable 380 of the cable assembly 300*b* is depicted as splitting at or in the vicinity of the upper coupling 370, it will be apparent to those skilled in the art that other physical configurations of the cable 380 that accommodate the separation of incoming and outgoing signals among the pair of lower couplings 390 are possible.

Figure 2:
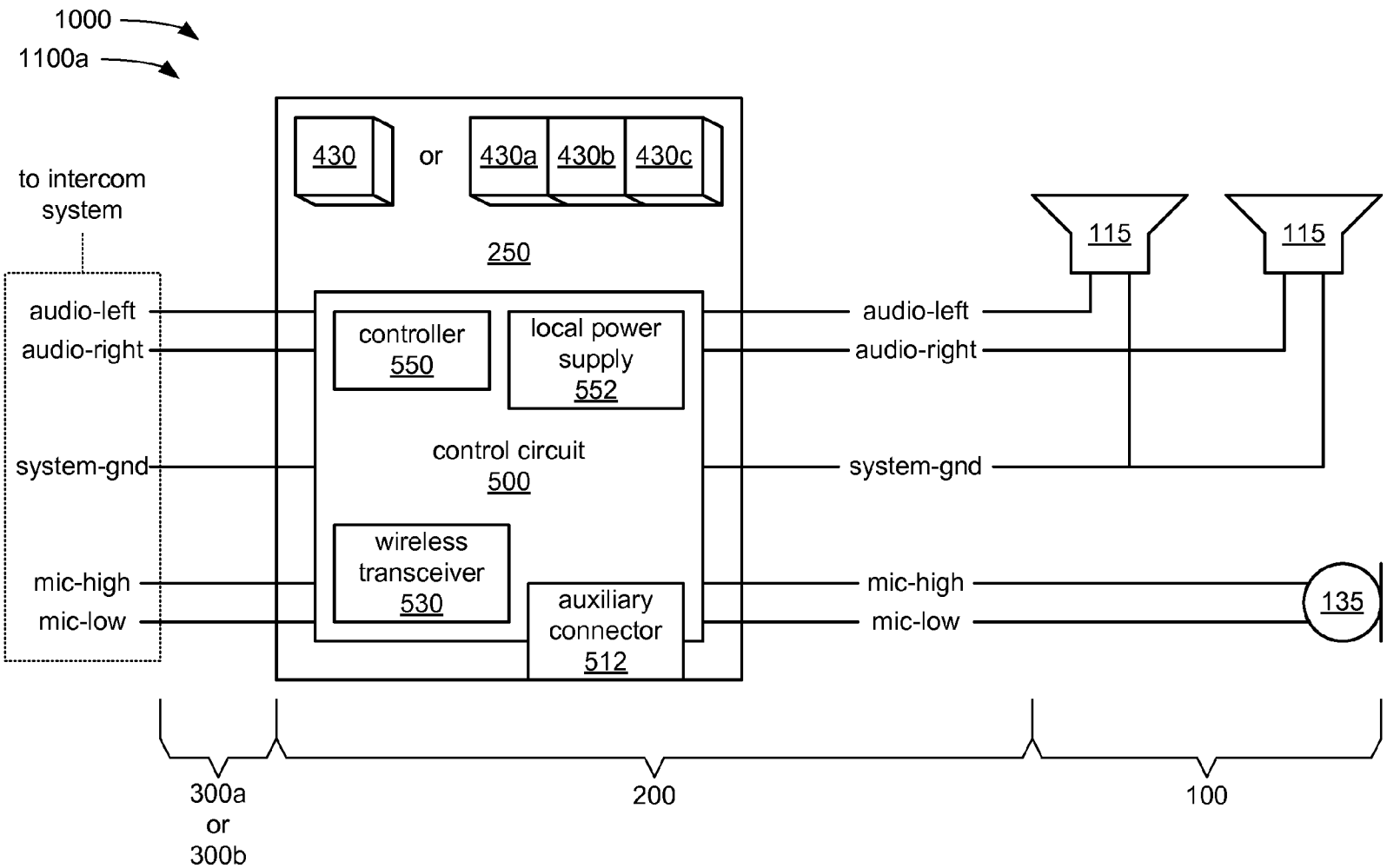
FIG. 2 is a block diagram of an electrical architecture employable in the headset of FIG. 1.

FIG. 2 depicts a possible embodiment of an electrical architecture that may be employed by the headset 1000, including within the control circuit 500. With one or the other of the lower cable assemblies 300*a* and 300*b* coupling the control box 250 of upper cable assembly 200 to an intercom system, and with the control box 250 being coupled to the head assembly 100 via the rest of the upper cable assembly 200, left and right audio signals (along with system ground) are able to be conveyed from the intercom system to the acoustic drivers 115, and high and low microphone signals are able to be conveyed from the communications microphone 135 to the intercom system. The control circuit 500 incorporated within the control box 250 monitors user operation of pushbutton switches 430*a*, 430*b* and 430*c*, monitors the coupling of the headset 1000 to an intercom system and controls the conveying of these signals, and controls the local coupling of the system ground of the acoustic drivers 115 to the microphone low signal of the communications microphone 135. In this way, the headset 1000 is able to be employed in interactions by a user with numerous possible combinations of an intercom system, a wireless device 800 and a wired device 900. In employing this electrical architecture, the control circuit 500 incorporates an auxiliary connector 512, a wireless transceiver 530, a controller 550. The controller 550 is coupled to these and other components of the control circuit 500 to monitor and/or control their functions as will be explained in greater detail.

Components of the control circuit 500 combine the left and right audio signals provided by an intercom system (if the headset 1000 is coupled to an intercom system) with audio provided by a wired device (if the headset 1000 is coupled to a wired device via the auxiliary connector 512), and audio received by the wireless transceiver 530 (if active). Where a source of audio provides only single-channel audio (otherwise known as "mono"), the control circuit 500 may combine that audio with only one of the audio-left and audio-right signals, or both. As depicted, the control box 250 and/or at least one of the earpieces 110*a* and 110*b* may carry one or more manually-operable controls (e.g., one or more of the switches 430*a-c*) to enable a user of the headset 1000 to select or in some other way control what sources of audio are ultimately conveyed to the acoustic drivers 115.

The wireless transceiver 530 enables a wireless device (such as the wireless device 800 depicted in FIG. 1) to be wirelessly coupled to the control circuit 500 to thereby allow audio received from the wireless device to be summed with other audio and to allow sounds detected by the communications microphone 135 to transmitted to the wireless device. In this way, two-way audio communications is enabled between the headset 1000 and such a wireless device. In various embodiments, the wireless coupling may be through radio frequency (RF) signals, possibly RF signals meant to comply with one or more widely known and used industry standards for RF communication including, and not limited to, the Bluetooth specification promulgated by the Bluetooth SIG based in Bellevue, Washington, or the ZigBee specification promulgated by the ZigBee Alliance based in San Ramon, Calif.

The controller 550 may be implemented in any of a number of ways. In some embodiments, the controller 550 is a combination of a processing device and a storage device in which is stored a sequence of instructions that is executed by the processing device of the controller 550 to cause that processing device to perform a number of tasks as are described herein. Possible implementations of such a processing device include, and are not limited to, a general purpose central processing unit (CPU), a digital signal processor (DSP), a microcontroller, a sequencer, and a state machine implemented with discrete logic. Possible implementations of such a storage include, and are not limited to, dynamic random access memory (DRAM), static random access memory (SRAM), read-only memory (ROM), electrically erasable programmable read-only memory (EEPROM), any of a variety of other types of volatile and/or non-volatile solid state memory storage technologies, magnetic and/or optical storage media, and any of a variety of other types of storage media.

Figure 3:
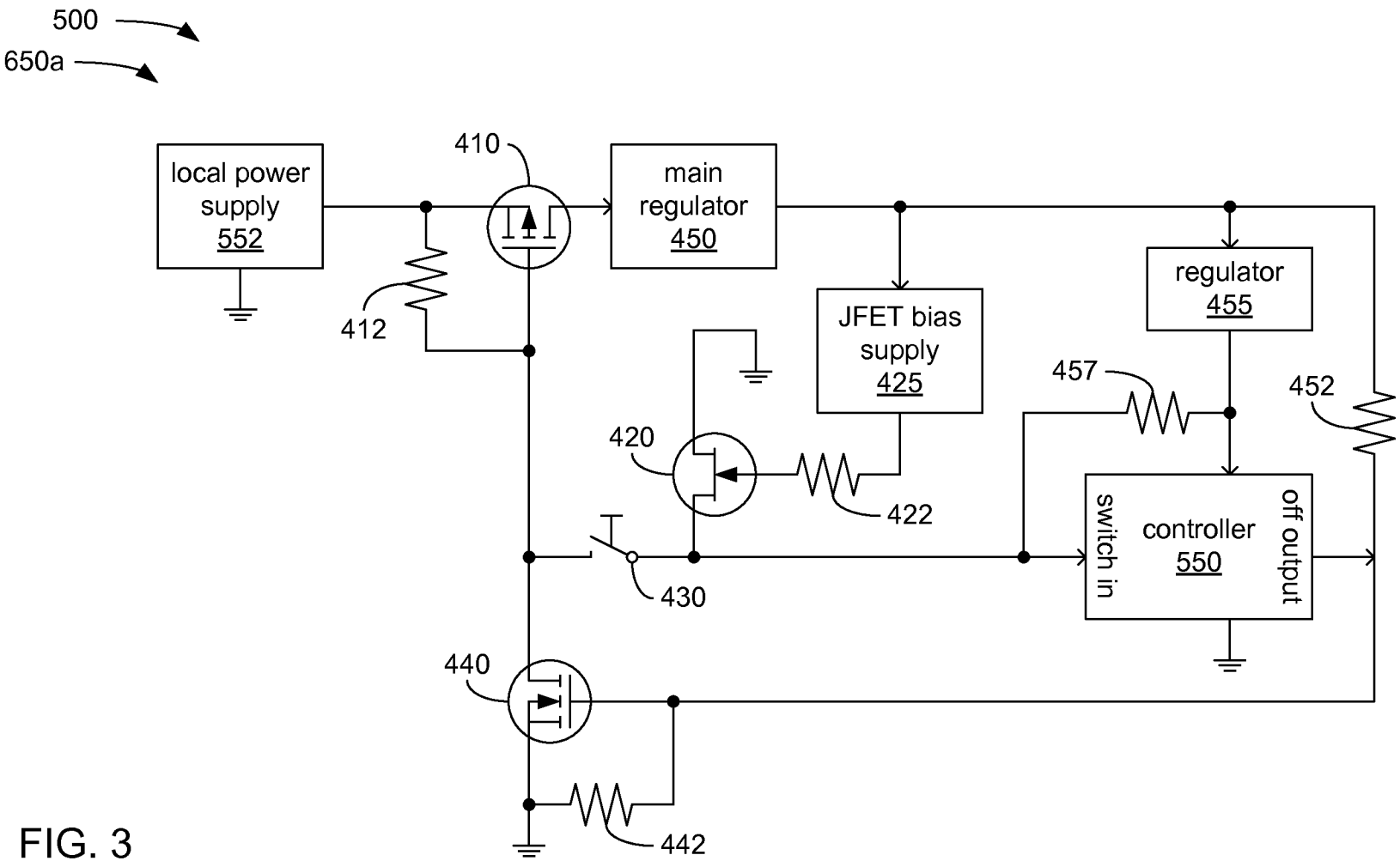
FIGS. 3, 4 and 5 are each block diagrams of electrical architecture portions that may be added to the electrical architecture of FIG. 2 to add a pushbutton power switch and supporting components that do not draw power while the headset of FIG. 1 is in an off state.

FIG. 3 depicts a portion 650*a* of an electrical architecture that may be added to the electrical architecture depicted in FIG. 2 (or to the electrical architectures of other possible embodiments of the headset 1000) to provide a user of the headset 1000 with a form of pushbutton power switch supported with other components selected and interconnected in a manner that consumes no power from the local power supply 552 until it is used to turn the headset 1000 on. This may be deemed desirable where the local power supply 552 is a power source of limited capacity (e.g., a battery) such that it is seen as undesired to provide a pushbutton power switch that is monitored by the controller 550 in a manner in which the controller 550 must continuously draw power from the local power supply 552, even at times when the headset 1000 appears to be "off" from the perspective of a user.

In the electrical architecture portion 650*a*, the control circuit 500 further incorporates MOSFETs 410 and 440; resistors 412, 422, 442, 452 and 457; a JFET 420; a JFET bias supply 425; a pushbutton switch 430; and voltage regulators 450 and 455. A high voltage potential terminal of the local power supply 552 is coupled to the resistor 412 and the input of the main voltage regulator 450 through the MOSFET 410 (i.e., is coupled to the source of the MOSFET 410, with the drain of the MOSFET coupled to the input of the main voltage regulator 450). A low voltage potential terminal of the local power supply 552 is coupled to the system-gnd conductor (a.k.a., "ground"). The resistor 412 is coupled to the gate of the MOSFET 410 (as well as to the source), the switch 430 and the drain of the MOSFET 440. The output of the main voltage regulator 450 is coupled to the input of the JFET bias supply 425, the input of the regulator 455 and the resistor 452. The output of the JFET bias supply is coupled to the gate of the JFET 420 through the resistor 422. The output of the regulator 455 is coupled to the controller 550 and both the JFET 420 and the switch 430 through the resistor 457, as well as being coupled to a switch input of the controller 550 through the resistor 457. The resistor 452 is coupled to an off output of the controller 550, to the gate of the MOSFET 440 and to ground (i.e., the system-gnd conductor to which the low voltage potential terminal of the local power source is also coupled) through the resistor 442. The JFET 420 and the source of the MOSFET 440 are also both coupled to ground.

At a time when the headset 1000 is powered off, the gate of the MOSFET 410 is provided with the same high voltage potential of the local power supply 552 as its source through the resistor 412 such that the MOSFET 410 is in a non-conductive state and does not allow current to pass through it. The gate of the MOSFET 440 is provided with the low voltage potential through the resistor 442 such that the MOSFET 440 is also in a non-conductive state and also does not allow current to pass through it. In contrast, the gate of the JFET 420 is provided with a low voltage potential through the resistor 422 from the JFET bias supply 425 such that the JFET enters a conductive state in which it allows current to pass between its source and drain. The JFET bias power supply 425 provides no bias to the gate of the JFET 420 resulting in the JFET 420 being in a conductive state that couples the switch 430 to ground.

Thus, when the headset 1000 is powered off, no power reaches the main regulator 450 from the local power supply 552, and therefore, the JFET bias supply 425, the regulator 455 and the controller 550 are not provided with power. The MOSFET 410 is selected to be the device that gates the flow of electric power from the local power supply 552 to these components due to its ability to provide an extremely high resistance between its source and drain. The MOSFET 410 is also selected due to its lack of current flow through its gate such that high voltage potential of the output of the local power supply 552 is able to be provided through the resistor 412 to the gate of the MOSFET 410 without the MOSFET 410 providing a path for current flow through its gate that would eventually drain the local power supply 552.

It is important to note that, technically speaking, there is still a leakage current that flows through the MOSFETs 410 and 440 while in their non-conductive states. However, as those skilled in the art will already recognize, variants of MOSFETs are available in which this leakage current is so very small, that the leakage between the poles within a battery, the leakage between two contacts of a mechanical switch separated by open air and the leakage between two adjacent traces on typical circuitboards can each be greater than the leakage through some types of MOSFETs that may be employed as the MOSFETs 410 and 440. Therefore, in stating that the circuits depicted in each of the electrical architecture portion 650*a* does not draw power from the local power supply 552, it is being stated that effectively, the current flow from the local power supply through either of the MOSFETs 410 and 440 is so very negligible that it can be ignored to the extent of being able to say that there is no current flow. In effect, where the local power supply 552 is a battery, the local power supply 552 will literally drain itself of power through the inherent self-leakage of typical batteries long before any other portion of the electrical architecture portion 650*a* will do so.

Therefore, as long as the high voltage potential of the local power supply 552 continues to be provided to the gate of the MOSFET 410, no current flows from the local power supply 552 to the other components depicted in FIG. 10. Yet, the JFET 420 is in a conductive state in which it serves to couple the normally-open pushbutton switch 430 to ground. When a user operates the pushbutton switch 430 to close it, the gate of the MOSFET 410 is then coupled through the pushbutton switch 430 and the JFET 420 to ground, thereby removing the high voltage potential previously provided to the gate of the MOSFET 410. With this change to the low potential of the ground being applied to the gate of the MOSFET 410, the MOSFET 410 responds by allowing current to flow through between its source and drain such that the main regulator 450 is then provided with electric power from the local power supply. In turn, the main regulator provides electric power (at one regulated voltage) to the gate of the MOSFET 440 through the resistor 452. The MOSFET 440 responds to the provision of the high voltage potential of the output of the main regulator 450 through the resistor 452 to its gate by switching to being in a conductive state such that it couples the gate of the MOSFET 410 through its own source and drain. This interaction between the MOSFETs 410 and 440 serves to latch both MOSFETs in their conductive state such that the MOSFET 410 continues to allow current to flow from the local power supply 552 to the main regulator 450 and the MOSFET 440 continues to couple the gate of the MOSFET 410 to ground.

The main regulator 450 also provides power to the regulator 455, which in turn, provides electric power to the controller 550 (at another regulated voltage) and provides a positive voltage potential to the conductor coupling the pushbutton switch 430 to an input of the controller 550. Further, an output of the controller 550 is coupled to the conductor coupling the resistor 452 to the gate of the MOSFET 440. It is through this conductor coupling the output of the controller 550 to the gate of the MOSFET 440 that the controller 550 is able to autonomously turn off the headset 1000 by pulling this conductor down to a low voltage potential, such that the MOSFET 440 ceases to couple the gate of the MOSFET 410 to ground, thereby undoing the latching interaction between the MOSFETs 410 and 440.

The main regulator 450 further provides electric power to the JFET bias supply 425, which in turn, provides a negative voltage potential to the gate of the JFET 420 through the resistor 422. The JFET 420 responds to the change from a low voltage potential to a negative voltage potential at its gate by switching to a non-conductive state such that it no longer couples the pushbutton switch 430 through its source and drain to ground (i.e., the system-gnd conductor). With one side of the pushbutton switch 430 now being coupled to ground through the MOSFET 440, and with the other side of the pushbutton switch 430 being coupled to the switch input of the controller 550 and the pull-up resistor 457, the normally-open pushbutton switch 430 is now able to serve as an input control to the controller 550 that is operable by a user of the headset 1000 to control various aspects of the operation of the headset 1000. The pull-up resistor 457 pulls the voltage potential at the switch input of the controller 550 to a high voltage, and closing the switch 430 couples the switch input of the controller 550 through the switch 430 and the MOSFET 440 (now in a conductive state) to ground (i.e., the low potential of the system-gnd conductor).

The controller 550 may be or may incorporate a processing device that executes a routine made up of a sequence of instructions stored within a storage of the controller 550 that causes the processing device to monitor the switch input of the controller 550 for instances of the switch input being pulled down to a low voltage potential, thereby effectively monitoring the state of the switch 430. Execution of the routine by the processing device may put in place various responses to particular sequences of operation of the switch by a user of the headset 1000, thereby possibly allowing the user of the headset 1000 to control various features of its functionality through differing combinations of relatively rapid sequences of button presses and/or button presses of particular durations. By way of example, a quick pressing of the switch 430 two times in rapid succession (what might be called a quick "double-press") may adjust a volume with which audio is acoustically output by the acoustic drivers 115. By way of another example, a single button press lasting a minimum of a predetermined number of seconds (what might be called a "press-and-hold") may signal the controller (i.e., the processing device of the controller) to turn off the headset 1000. Thus, in this way, the switch 430 may also be used as an "off switch" by the user.

This dual use of the switch 430 as both the "on" button and the "off" button is thereby accomplished with the "on" function of the switch 430 being accomplished through the latching interaction of the MOSFETs 410 and 440 without any participation by the controller 550, while the "off" function of the switch 430 does require action by the controller 550 to accomplish. This can provide the headset 1000 with a useful "failsafe" feature in which the headset 1000 can be turned "on" such that at least basic functions are fully powered, even if the controller 550 is in some way malfunctioning. For operators of vehicles or large machinery where being able to use the headset 1000 to communicate with others without interruption is extremely important (e.g., a pilot in an airplane, an operator of a submersible vehicle, etc.).

As those skilled in the art of the operation of processing devices executing sequences of routines are well aware, even where a routine does not contain an error that causes a processing device to act unpredictably, memory errors, static discharge events, overheating of components, etc., can cause a processing device to cease to execute a sequence of instructions correctly, such that it becomes unresponsive. In more conventional pushbutton on switch controls, where a processing device is relied upon to repeatedly monitor a switch for an instance of it being operated to turn on a device, an event causing the processing device to cease to execute instructions correctly can easily result in a user's use of that switch to turn on that device being entirely ignored. In contrast, the decided lack of reliance on the controller 550 to in any way participate in responding to a user's operation of the switch 430 to turn on the headset 1000 means that the headset 1000 can be turned on by a user and used even where the controller 550 is utterly unresponsive, thereby helping to ensure that the user will be able to use the headset 1000 to continue to engage in necessary communications, even with such a malfunction in progress.

Figure 4:
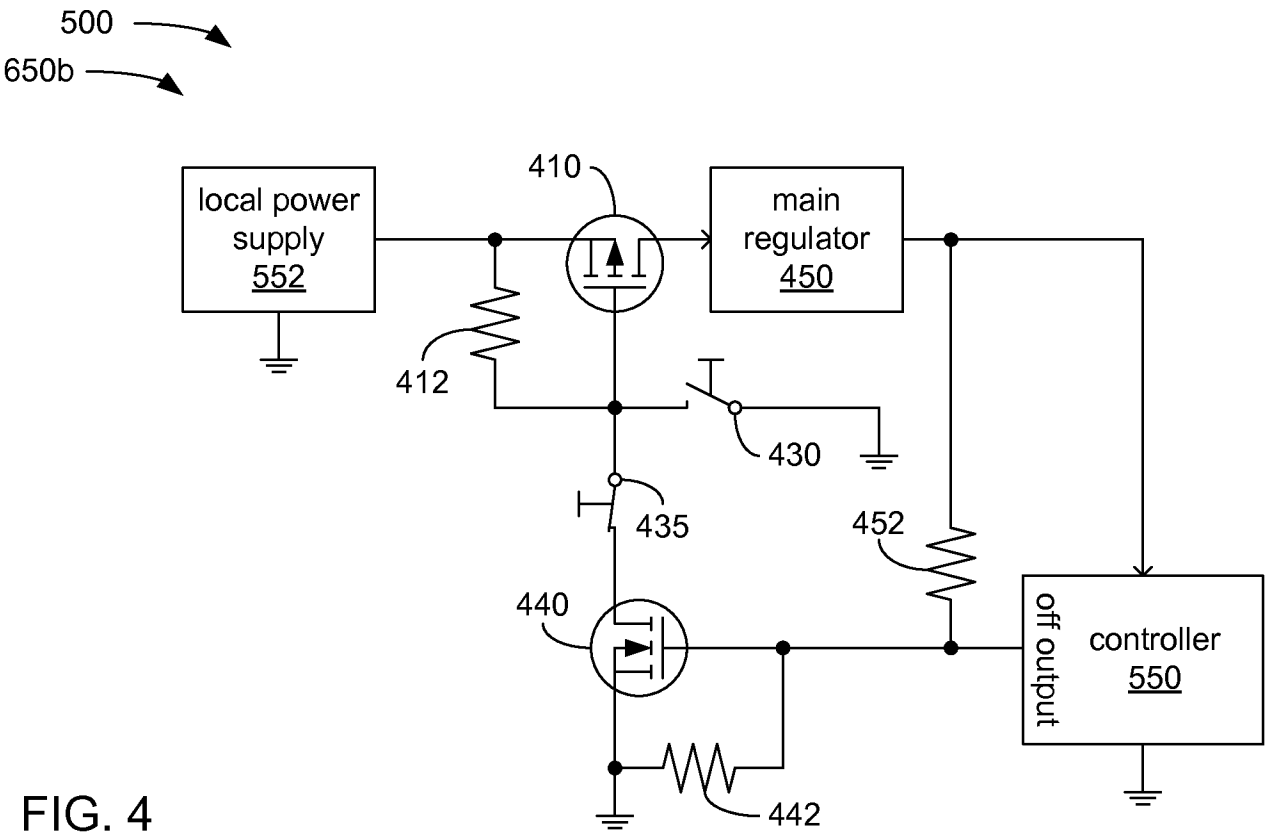

FIG. 4 depicts an alternate portion 650*b* of an electrical architecture that may be added to the electrical architecture depicted in FIG. 2 (or to the electrical architectures of other possible embodiments of the headset 1000) to provide a user of the headset 1000 with a form of dual pushbutton power switch supported with other components selected and interconnected in a manner that consumes no power from the local power supply 552 until it is used to turn the headset 1000 on. The electrical architecture portion 650*b* differs from the electrical architecture portion 650*a* in that numerous components of the electrical architecture portion 650*a* have been removed, and a normally closed switch 435 has been added.

Again, the local power supply 552 is coupled to the resistor 412 and the input of the main voltage regulator 450 through the MOSFET 410. The resistor 412 is coupled to the gate of the MOSFET 410, the switch 430 and the MOSFET 440 through the switch 435. The output of the main voltage regulator 450 is coupled to the controller 550 and the resistor 452. The resistor 452 is coupled to an off output of the controller 550, to the gate of the MOSFET 440 and to ground (i.e., the system-gnd conductor) through the resistor 442. The MOSFET 440 is also both coupled to ground.

At a time when the headset 1000 is powered off, the gate of the MOSFET 410 is provided with the same high voltage potential of the local power supply 552 as its source through the resistor 412 such that the MOSFET 410 is in a non-conductive state and does not allow current to pass through it. The gate of the MOSFET 440 is provided with the low voltage potential through the resistor 442 such that the MOSFET 440 is also in a non-conductive state and also does not allow current to pass through it. Therefore, as long as the high voltage potential of the local power supply 552 continues to be provided to the gate of the MOSFET 410, no current flows from the local power supply 552 to the other components depicted in FIG. 11.

When a user operates the pushbutton switch 430 to close it, the gate of the MOSFET 410 is then coupled through the pushbutton switch 430 and the JFET 420 to ground (i.e., the system-gnd conductor), thereby removing the high voltage potential previously provided to the gate of the MOSFET 410. With this change to the low potential of the ground being applied to the gate of the MOSFET 410, the MOSFET 410 responds by allowing current to flow through between its source and drain such that the main regulator 450 is then provided with electric power from the local power supply. In turn, the main regulator provides electric power (at one regulated voltage) to the gate of the MOSFET 440 through the resistor 452. The MOSFET 440 responds to the provision of the high voltage potential of the output of the main regulator 450 through the resistor 452 to its gate by switching to being in a conductive state such that it couples the gate of the MOSFET 410 through its own source and drain. This interaction between the MOSFETs 410 and 440 serves to latch both MOSFETs in their conductive state such that the MOSFET 410 continues to allow current to flow from the local power supply 552 to the main regulator 450 and the MOSFET 440 continues to couple the gate of the MOSFET 410 to ground.

The main regulator 450 also provides power to the controller 550. Further, an output of the controller 550 is coupled to the conductor coupling the resistor 452 to the gate of the MOSFET 440. It is through this conductor coupling the output of the controller 550 to the gate of the MOSFET 440 that the controller 550 is able to autonomously turn off the headset 1000 by pulling this conductor down to a low voltage potential, such that the MOSFET 440 ceases to couple the gate of the MOSFET 410 to ground, thereby undoing the latching interaction between the MOSFETs 410 and 440. The normally-closed switch 435 provides a mechanism by which a user is able to turn off the headset 1000 by directly breaking the coupling of the gate of the MOSFET 410 to ground through the MOSFET 440 when the switch 435 is operated from its normally-closed state to an open state. This undoes the latching interaction between the MOSFETs 410 and 440, causing the MOSFET 410 to return to a non-conductive state, thereby depriving the MOSFET 440 of the high voltage potential presented to its gate through the regulator 450 and the resistor 452. The provision of both of the switches 430 and 435 to enable the headset 1000 to be both turned on and turned off without involvement of the controller 550 may be deemed desirable where the ability to turn the headset 1000 off despite a malfunction of the controller 550 is wanted.

Figure 5:
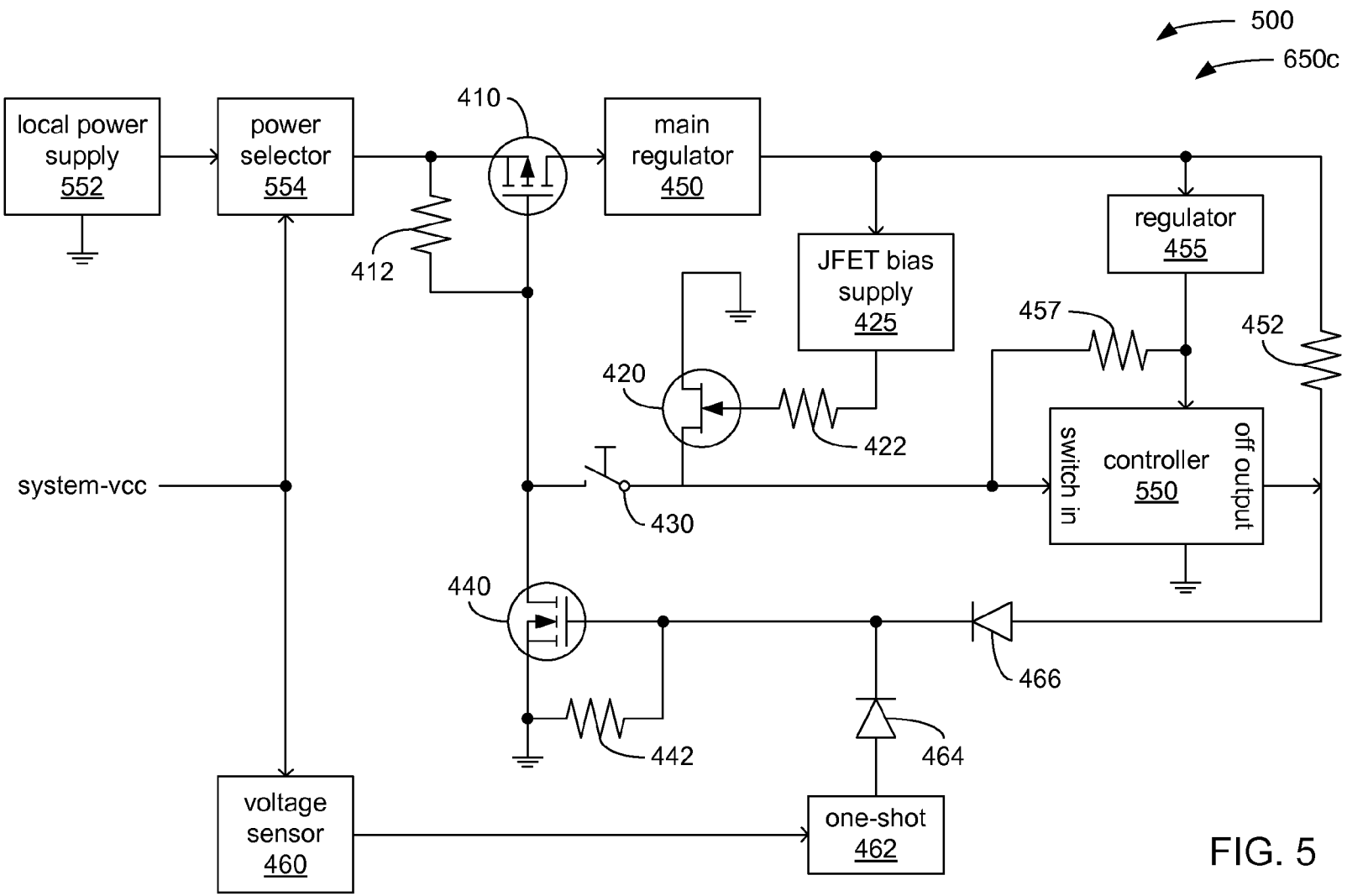

FIG. 5 depicts a portion 650*c* of yet another electrical architecture that may be added to either of the electrical architecture depicted in FIG. 2 (or to the electrical architectures of other possible embodiments of the headset 1000) to provide a user of the headset 1000 with a form of pushbutton power switch supported with other components selected and interconnected in a manner that consumes no power from the local power supply 552 until it is used to turn the headset 1000 on. The electrical architecture portion 650*c* is substantially similar to the electrical architecture portion 650*a*, with the exception that the electrical architecture portion 650*c* adds the facility to cause the headset 1000 to be automatically turned on when coupled to an intercom system that provides electric power via a system-vcc conductor, in addition to providing the ability to automatically switch to drawing power from the local power supply 552 when power is not provided by an intercom system.

In the electrical architecture portion 650*c*, the power selector 554 is interposed between the local power supply 552 and both the MOSFET 410 and the resistor 412 to enable the power selector 554 to automatically select between power provided by the local power supply 552 and power provided via the system-vcc conductor. In some embodiments, the power selector 554 is a power multiplexer that automatically selects whichever power source provides power with a greater voltage, and the local power supply is selected and/or configured to always provide power with a lesser voltage than the electric power expected to be received from an intercom system via the system-vcc conductor. In this way, the power selector 554 is caused to always select the electric power provided by the system-vcc conductor when that electric power is available so as to attempt to conserve the electric power provided by the local power supply 552.

The system-vcc conductor is also coupled to a voltage sensor 460 that is further coupled to a one-shot 462 (also commonly referred to as "monostable multivibrator" or "mono-shot"). The voltage sensor 460 monitors the system-vcc conductor for transitions in the state of the system-vcc from a low voltage potential (relative to the system-gnd conductor) associated with no power being provided by an intercom system to a high voltage potential associated with such power being provided. Where such transitions occur, the voltage sensor 460 electrically signals the one-shot 462 to inject a pulse of a high voltage potential through a diode 464 to the gate of the MOSFET 440. The length of the high potential pulse output by the one-shot 462 is selected to ensure that the MOSFET 440 is put into a conductive state with a high voltage potential at its gate for a long enough time to cause the MOSFET 410 to enter into a conductive state that enables electric power to be provided to the main regulator 450 (now from the system-vcc conductor), which in turn, causes a high voltage potential to be provided to the gate of the MOSFET 440 through the resistor 452 and through another diode 466. This has the effect of causing the MOSFETs 410 and 440 to engage in a latching interaction. The diodes 464 and 466 serve to protect the main regulator 450 and the one-shot 462 from damaging one another.

It should be noted that although much of the discussion of the power control features, including actions taken by the controller 550 in response to changing circumstances to turn on or off components, and including the latching interaction and zero power drain of the MOSFETs 410 and 440 in conjunction with the switch 430, has centered on the headset 1000, and even more particularly to the user of the headset 1000 with an intercom of an airplane, it should be noted that these power control features may also be employed in other personal audio devices. Such other personal audio devices include, but are not limited to, headphones (including in-ear, over-the-ear, and around-the-ear variants), walkie talkies, corded microphones for two-way radios, wireless headsets, pairs of headphones (with or without ANR capability), etc. These features are believed to be of use in any form of personal audio device in which there is need to conserve electric power provided by a power source of limited capacity.

Figure 6:
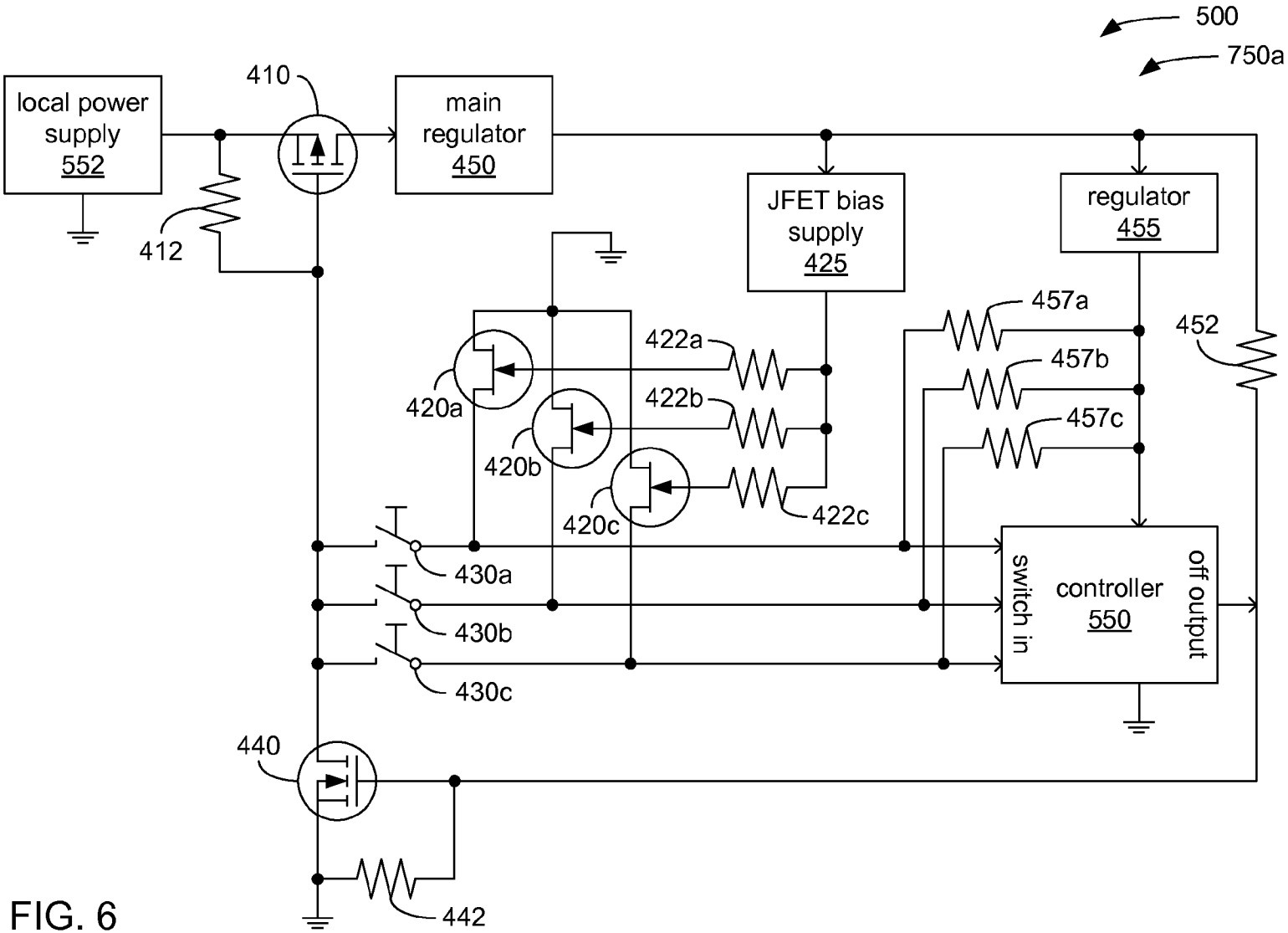
FIGS. 6, 7 and 8 are each block diagrams of electrical architecture portions that may be added to the electrical architecture of FIG. 2 to add pushbutton switches serving both as power switches and as user input switches for various designated functions, and supporting components that do not draw power while the headset of FIG. 1 is in an off state.

FIG. 6 depicts a portion 750*a* of an electrical architecture that may be added to either of the electrical architecture depicted in FIG. 2 (or to the electrical architectures of other possible embodiments of the headset 1000) to provide a user of the headset 1000 with multiple pushbutton switches, each of which may perform a function entirely unrelated to serving as a power on or power off switch, but each of which is capable of serving as at least a power on switch, and each of which supported with other components selected and interconnected in a manner that consumes no power from the local power supply 552 until it is used to turn the headset 1000 on. The electrical architecture portion 750*a* is substantially similar to the electrical architecture portion 650*a*, with the exception that the electrical architecture portion 750*a* adds the facility to cause the headset 1000 to be turned when any of these pushbutton switches is operated while the headset 1000 is powered off.

In the electrical architecture portion 750*a* (in comparison to what is depicted of the electrical architecture portion 650*a*), the combination of single JFET 420 and single resistor 422 is replaced with multiple JFETs 420*a*, 420*b* and 420*c* and multiple corresponding resistors 422*a*, 422*b* and 422*c;* the single pushbutton switch 430 is replaced with multiple pushbutton switches 430*a*, 430*b* and 430*c* (each one of which corresponds to one of the JFETs 420*a-c* and one of the resistors 422*a-c*); the single resistor 457 is replaced with multiple resistors 457*a*, 457*b* and 457*c* (each one of which corresponds to one of the JFETs 420*a-c*, one of the resistors 422*a-c* and one of the pushbutton switches 430*a-c*, respectively). Further, the single "switch in" input of the controller 550 used in the electrical architecture portion 650*a* to monitor the state of the single pushbutton switch 430 is replaced with multiple "switch in" inputs, each of which monitors the state of one of the multiple pushbutton switches 430*a-c*. In essence, the combination of and the couplings among the JFET 420, the pushbutton switch 430, the resistor 457 and the controller 550 of the electrical architecture portion 650*a* has been replicated multiple times in the electrical architecture portion 750*a*. The manner in which each of these replicated combinations interact to cause the latching interaction between the MOSFETs 410 and 440 to power on the headset 1000 is identical to the previously described interaction among the JFET 420, the pushbutton switch 430, the resistor 457 and the one "switch in" input of the controller 550. Also, the manner in which each of these replicated combinations interact to enable the provision of input by a user to the controller 550 is also identical to the previously described interaction among the JFET 420, the pushbutton switch 430, the resistor 457 and the one "switch in" input of the controller 550. As a result, where there was only a single pushbutton switch 430 depicted in the electrical architecture portion 650*a* as being capable of being employed to cause the latching engagement between the MOSFETs 410 and 440 to power on the headset 1000, the electrical architecture 750*a* has multiple pushbutton switches 430*a-c* that are capable of being so employed.

The provision of multiple pushbutton switches that are each capable of causing the headset 1000 provides a convenience feature for the benefit of a user of the headset 1000, and provides an opportunity to reduce the quantity and complexity of the manually-operable controls carried the headset 1000. More simply put, with multiple ones of the pushbutton (or other) switches (if not all of such switches) being made capable of serving as a power switch for powering on the headset 1000, the need for a particular pushbutton switch to serve as a distinct power switch (at least while the headset 1000 is powered off) is eliminated. Each of the pushbutton switches 430*a-c* is able to be operated to control an aspect of the function of the headset 1000 (e.g., "mute," "volume up," "volume down," "input select," etc.), and none of the pushbutton switches need be "wasted" by being dedicated to serving as a power on switch. This is based on an assumption that a user would not press one of the pushbutton switches 430*a-c* that has been assigned such a function as "input select" or "volume up" or "mute" unless the user is choosing to operate the headset 1000, and thus, it can be assumed that a user who is pressing one the pushbutton switches 430*a-c* desires that the headset 1000 be powered on, if it isn't powered on, already. Thus, if the headset 1000 is powered off and a user desires to power it on, that user need only press the one of the pushbutton switches 430*a-c* that corresponds to the first command input that the user desires to provide to the headset 1000 without having to begin with the extra step of pressing a pushbutton switch that has been dedicated to serve as the switch for powering on the headset 1000 when it is off. In other words, the user can immediately proceed to operating the manually-operable controls of the headset 1000 without having to first take specific steps to cause the headset 1000 to be powered on.

To enable the pushbutton switches 430*a-c* to be used to serve these simultaneous roles of both powering on the headset 1000 and accepting being operated by a user as an indication of a specific user input, the controller 550 latches the states of each of its "switch in" inputs quickly enough after being provided with power (through the MOSFET 410, the main regulator 450 and the regulator 455) as to capture which one of the pushbutton switches 430*a-c* was pressed by a user while that user is still pressing that one of the pushbutton switches 430*a-c* (i.e., latches quickly enough that the user has not yet been able to release that one of these pushbutton switches before latching occurs). In this way, for example, the controller 550 is able to distinguish between use of a "mute" button and an "input select" button to power on the headset, and is able to either immediately mute the microphone 135 or to immediately select a desired input upon the powering on of the headset 1000.

To effectively latch the states of each of the pushbutton switches 430*a-c* once the controller 550 is provided with power, the latching of the "switch in" inputs of the controller 550 is timed to occur shortly after the gates of the JFETs 420*a-c* are provided with a negative voltage potential such that all three of the JFETs 420*a-c* are caused to enter non-conductive states in which they cease to ground the conductors coupling each of the pushbutton switches 420*a-c* to the "switch in" inputs of the controller 550 and corresponding ones of the resistors 457*a-c*. With the cessation of such grounding, those same conductors are able to be pulled up to a positive potential voltage output of the regulator 455 through separate ones of the resistors 457*a-c*. And with the resistors 457*a-c* acting as pull-up resistors, the controller 550 is able to distinguish which one of the pushbutton switches 430*a-c* is being pressed by the user, since that one of these pushbutton switches will cause its associated one of these conductors to be pulled low by being coupled through that one of these pushbuttons switches to the conductor coupling the JFETs 410 and 440 (which will be at a low potential voltage as part of the previously described latching interaction between them). Thus, upon being provided with power by the regulator 455, the controller 550 latches the state (i.e., the voltage levels) of the conductors coupling the switches 430*a-c* to its "switch in" inputs (at a time after the JFETs 420*a-c* have entered a non-conductive state, but before the user has ceased pressing whichever one of the pushbutton switches 430*a-c* that the user is pressing), and the pushbutton switch being pressed by the user is the one that corresponds to whichever one of those conductors is at a low voltage level when the latching occurs.

Thus, for example, a user is able to power on the headset 1000 by pressing whichever one of the pushbutton switches 430*a-c* has been designated as being the "mute" button, or by pressing whichever one of the pushbutton switches 430*a-c* has been designated as being the "input select" button. A processing device of the controller 550 executes a sequence of instructions of a control routine stored within the controller 550 that causes that processing device to examine the latched states of the conductors coupling the pushbutton switches 430*a-c* to the "switch in" inputs of the controller 550. If the one of those conductors corresponding to the one of the pushbutton switches 430*a-c* designated as the "mute" button was latched in a low voltage potential state, then the controller 550 is caused by the sequence of instructions to mute the microphone 135 shortly after the headset 1000 is powered on. If, instead, the one of those conductors corresponding to the one of the pushbutton switches 430*a-c* designated as the "input select" button was latched in a low voltage potential state, then the controller 550 is caused by the sequence of instructions to select whatever audio input was specified by the user's action of pressing that one of the pushbutton switches 430*a-c* and convey the audio provided at that audio input to the acoustic drivers 115.

Figure 7:
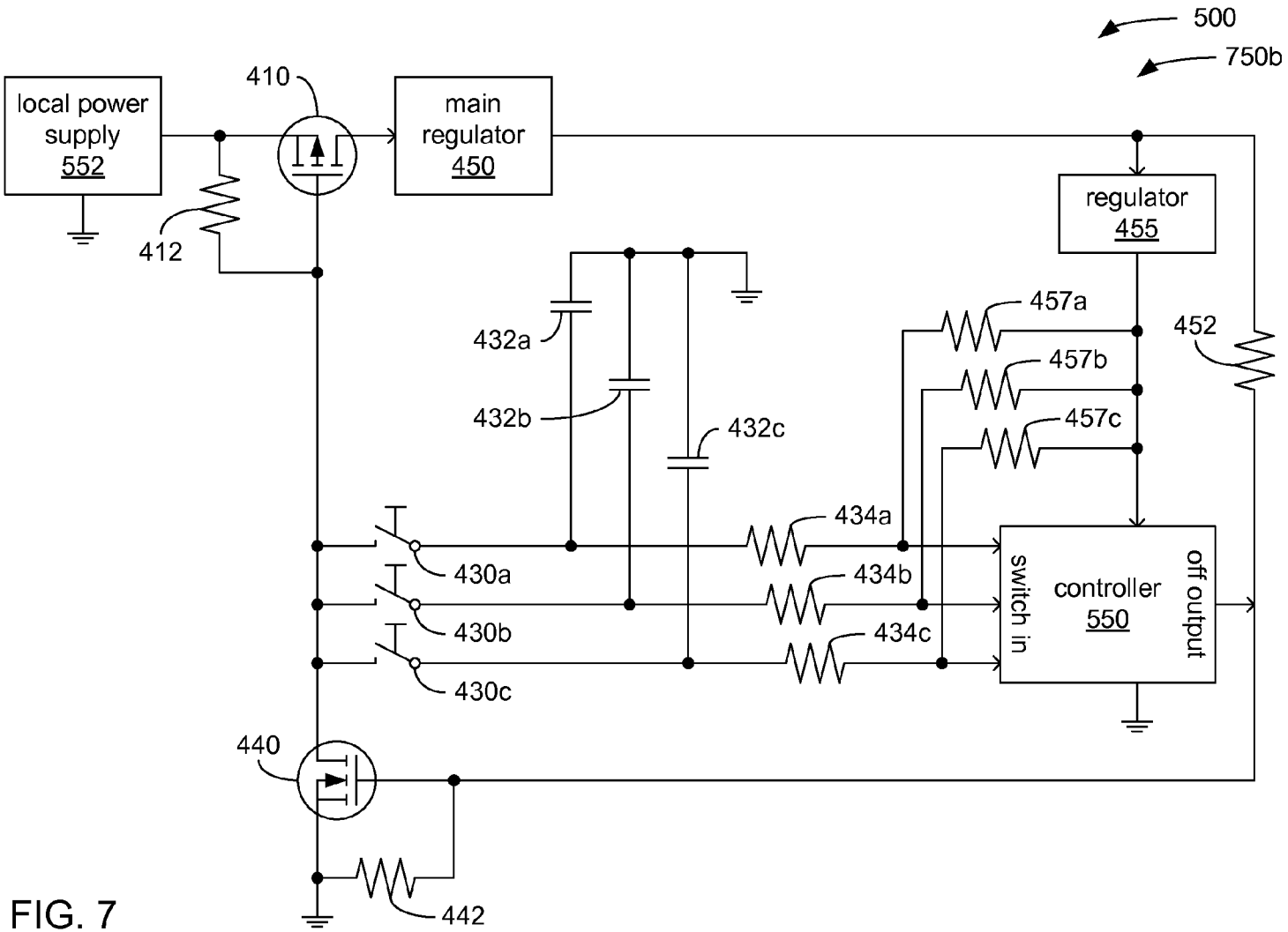

FIG. 7 depicts another portion 750*b* of an electrical architecture that may be added to either of the electrical architecture depicted in FIG. 2 (or to the electrical architectures of other possible embodiments of the headset 1000) to provide a user of the headset 1000 with multiple pushbutton switches, each of which may perform a function entirely unrelated to serving as a power on or power off switch, but each of which is capable of serving as at least a power on switch, and each of which supported with other components selected and interconnected in a manner that consumes no power from the local power supply 552 until it is used to turn the headset 1000 on. The electrical architecture portion 750*b* is substantially similar to the electrical architecture portion 750*a*, with the exception that the use of JFETs to initially provide low potentials to the switches 430*a-c* has been replaced with RC networks that allow the "switch in" inputs to also be operated as outputs.

In the electrical architecture portion 750*b* (in comparison to what is depicted of the electrical architecture portion 750*a*), the JFETs 420*a-c*, the resistors 422*a-c* and the JFET bias supply 426 have all been removed; and instead, each of the conductors coupled to the one of the switches 430*a-c* that was selectively coupled to ground through one of the JFETs 420*a-c* is now coupled to ground through corresponding ones of capacitors 432*a-c*, and each of these conductors is now coupled to one of the "switch in" inputs of the controller 550 through a corresponding one of resistors 434*a-c*. Each combination of one of the resistors 434*a-c* and corresponding one of the capacitors 432*a-c* forms an RC network that aids in coupling corresponding ones of the switches 430*a-c* to ground prior to the MOSFETs 410 and 440 engaging in the latching interaction that results in electric power being provided to the regulator 455, and each of these combinations of resistor and capacitor aids the controller 550 in latching the state of corresponding ones of the switches 430*a-c* soon enough following the controller 550 being provided that the identity of which one of the switches 430*a-c* was pressed by a user can be determined.

Additionally, the coupling of each of the switches 430*a-c* to its corresponding one of the "switch in" inputs of the controller 550 enables those same inputs to be further coupled to inputs of still other components (not shown) and for the same inputs to the controller 550 to now additionally be used as outputs convey signals to those inputs of those other components. It is preferred that a processing device of the controller 550 that executes a sequence of instructions of a control routine stored within the controller 550 monitor current operating conditions of the headset 1000 to preferably refrain from operating one or more of the "switch in" inputs as outputs at times when there is a higher likelihood of a user of the headset 1000 operating particular ones of the switches 430*a*, 430*b* or 430*c* such that a given one or more of the "switch in" inputs may be needed to monitor for corresponding ones of the switches 430*a-c* for an indication of such an action by a user.

Figure 8:
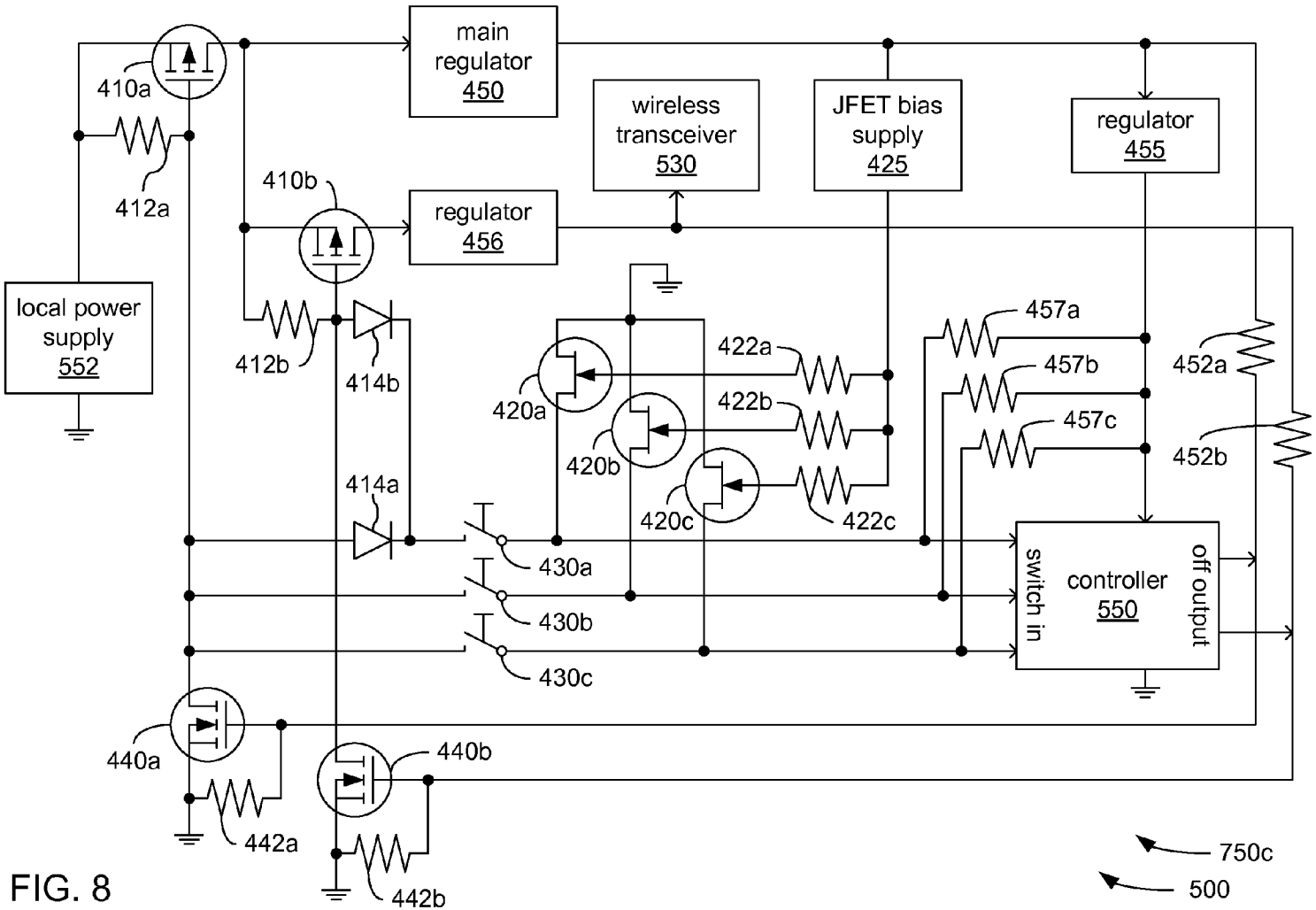

FIG. 8 depicts still another portion 750*c* of an electrical architecture that may be added to either of the electrical architecture depicted in FIG. 2 (or to the electrical architectures of other possible embodiments of the headset 1000) to provide a user of the headset 1000 with multiple pushbutton switches, each of which may perform a function entirely unrelated to serving as a power on or power off switch, but each of which is capable of serving as at least a power on switch, and each of which supported with other components selected and interconnected in a manner that consumes no power from the local power supply 552 until it is used to turn the headset 1000 on. The electrical architecture portion 750*c* is substantially similar to the electrical architecture portion 750*a*, with the exception that the electrical architecture portion 750*c* subdivides the provision of power from a power source to enable there being two variants of the "on" state of the headset 1000.

In the electrical architecture portion 750*c* (in comparison to what is depicted of the electrical architecture portion 750*a*), a second pair of MOSFETs 410*b* and 440*b* and a second trio of resistors 412*b*, 442*b* and 452*b* are added that roughly correspond in function to the MOSFETs 410 and 440 and the resistors 412, 442 and 452 of the electrical architecture portion 750*a*. Further, for sake of clarity of discussion regarding this electrical architecture portion 750*c*, the MOSFETs 410 and 440 and the resistors 412, 442 and 452 of the electrical architecture portion 750*a* have been relabeled as MOSFETs 410*a* and 440*a* and resistors 412*a*, 442*a* and 452*a*, respectively. Further, another regulator 456 has been added in parallel with the main regulator 450 (however, this new regulator 456 could be added in parallel with the regulator 455, instead, depending on power requirements) to separately provide electric power having a regulated voltage to the wireless transceiver 530. Still further, the manner in which the pushbutton switch 430*a* is coupled to the conductor coupling the MOSFETs 410*a* and 440*a* has been altered such that a diode 414*a* has been interposed between the pushbutton switch 430*a* and that conductor coupling the MOSFETs 412*a* and 442*a*. Correspondingly, another diode 414*b* has been similarly interposed between the pushbutton switch 430*a* and a conductor that similarly couples the MOSFETs 410*b* and 440*b*.

The manner in which the pushbutton switches 430*a-c* and the MOSFETs 410*a* and 440*a* interact in the electrical architecture portion 750*c* are identical to the manner in which the pushbutton switches 430*a-c* and the MOSFETs 410 and 440 interact in the electrical architecture portion 750*a* (including in the latching behavior between the MOSFETs 410 and 440, and correspondingly between the MOSFETs 410*a* and 440*a* to power on the headset 1000). The addition of the diode 414*a* between the pushbutton switch 430*a* and the conductor coupling the MOSFETs 410*a* and 440*a* does not alter this interaction among these components. However, with the addition of the MOSFETs 410*b* and 440*b*, the regulator 456, and the resistors 412*b*, 442*b* and 452*b*, the ability to separately power on the wireless transceiver 530 is added. And, with the coupling of the pushbutton switch 430*a* to the conductor coupling the MOSFETs 410*b* and 440*b* through the diode 414*b*, it is the pushbutton switch 430*a* that may be operated by a user of the headset 1000 to power on the wireless transceiver 530 along with the rest of the headset 1000.

The addition of such capability to the pushbutton switch 430*a* assumes that the pushbutton switch 430*a* is designated as controlling a function related to the use of the wireless transceiver 530 (e.g., forming a wireless point-to-point link with the wireless device 800 depicted in FIG. 1, placing or answering a cellular telephone call, acting as the "push-to-talk" where the headset 1000 is employed in with an intercom or two-way radio, etc.). Thus, where the headset 1000 is powered off, a user pressing either of the pushbutton switches 430*b* or 430*c* will cause the powering on of the headset 1000 in the manner that has been described, but without powering on the wireless transceiver 530. This prevents a consumption of power from the local power supply 552 by the wireless transceiver 530 at a time when the user presumably does not desire to make use of the wireless transceiver 530 (presuming that the pushbutton switches 430*b* and 430*c* provide control over functions that don't necessarily require the wireless transceiver 530 to be powered on). Alternatively, where the headset 1000 is powered off, a user pressing the pushbutton switch 430*a* will cause the powering on of the headset 1000 in the manner that has been described, as well as the powering on of the wireless transceiver 530 as a result of the MOSFETs 410*b* and 440*b* being caused to engage in a latching interaction that is substantially the same as the latching interaction engaged in by the MOSFETs 410*a* and 440*a*.

In a manner substantially identical to what was earlier described with regard to the electrical architecture portion 750*a*, the controller 550 in the electrical architecture portion 750*c* examines the state of the conductors coupling the pushbutton switches 430*a-c* to its "switch in" inputs shortly after being provided with power to determine which of these pushbutton switches were operated by a user to power on the headset 1000. A processing device of the controller 550 that executes a sequence of instructions of a control routine stored within the controller 550 may employ this information to determine whether or not the wireless transceiver 530 is also powered on, or may more directly monitor the wireless transceiver 530 for a signal indicating whether it is powered on, or not. Further, following the powering on of the headset 1000, the wireless transceiver 530 may be subsequently caused to be either powered on or powered off under the control of a processing device of the controller 550 executing a control routine in response to detecting operation of the pushbutton switch 430*a* (and/or another pushbutton switch). More precisely, where the controller 550 receives an indication via its "switch in" inputs that one of the pushbutton switches 430*a-c* has been operated in a manner that indicates that the wireless transceiver 530 should be powered on or powered off, the controller 550 may power on the wireless transceiver 530 by driving a high voltage potential onto the conductor coupling the output of the regulator 456 to the gate of the MOSFET 440*b* through the resistor 452*b*, or may power off the wireless transceiver 530 by driving a low voltage potential onto that conductor.

It should be noted that although much of the discussion of the power control features, including actions taken by the controller 550 in response to changing circumstances to turn on or off components, and including the latching interaction and zero power drain of the MOSFETs 410 and 440 in conjunction with the switch 430, has centered on the headset 1000, and even more particularly to the user of the headset 1000 with an intercom of an airplane, it should be noted that these power control features may also be employed in other personal audio devices. Such other personal audio devices include, but are not limited to, headphones (including in-ear, over-the-ear, and around-the-ear variants), walkie talkies, corded microphones for two-way radios, wireless headsets, pairs of headphones (with or without ANR capability), etc. These features are believed to be of use in any form of personal audio device in which there is need to conserve electric power provided by a power source of limited capacity.

Other embodiments and implementations are within the scope of the following claims and other claims to which the applicant may be entitled.

The invention claimed is:

1. An apparatus comprising:

a plurality of normally-open manually operable switches;

a first MOSFET having a first gate coupled to each switch of the plurality of switches, and a first source coupled to a high voltage potential terminal of a power source to receive electric power therefrom;

a second MOSFET having a second source coupled to a low voltage potential terminal of the power source; a second drain also coupled to the first gate of the first MOSFET, and a second gate to receive electric power from the power source through at least the first source and a first drain of the first MOSFET;

a plurality of third transistors each having a respective source coupled to the low potential terminal of the power source, a respective drain coupled to one of the switches of the plurality of switches, and a respective gate to receive a bias voltage through at least the first source and drain of the first MOSFET; and a controller coupled to the first drain and comprising a plurality of switch inputs, wherein each switch of the plurality of switches is coupled to a switch input of the plurality of switch inputs; and wherein closing one of the switches of the plurality of switches couples the first gate to the low potential voltage terminal of the power source through a corresponding one of the third transistors while the corresponding third transistor is in a conductive state, placing the first MOSFET into a conductive state, providing a high voltage potential through the first MOSFET to the second gate and to the controller, placing the second MOSFET into a conductive state, providing a low voltage potential to the first gate to latch the first and the second MOSFETs in a conductive state, and enabling the controller to latch the state of the plurality of switch inputs and to identify which one of the switches was closed, and placing the first MOSFET into the conductive state also provides the bias voltage through the first MOSFET to the gates of the plurality of third transistors, placing the third transistors into a non-conductive state, decoupling the switches from the low potential voltage terminal of the power source while the first MOSFET is in the conductive state.

2. The apparatus of claim 1, wherein:

each switch of the plurality of switches is designated as a manually-operable control enabling a user of the apparatus to control an aspect of a function of the apparatus; and the controller comprises a processing device executing a sequence of instructions stored within the controller and causing the processing device to act as indicated by a user having manually operated the one of the switches identified as closed.

3. The apparatus of claim 1, wherein:

the first drain is coupled to the second gate through a resistor;

the controller further comprises an off output coupled to the second gate enabling the controller drive a low voltage potential to the second gate to place the second MOSFET into a non-conductive state to cause the first and second MOSFETs to cease to be latched in a conductive state.

4. The apparatus of claim 1, wherein the second drain and the first gate are coupled through a normally closed switch that is manually operable to cause the first and second MOSFETs to cease to be latched in a conductive state.

5. A method of operating an apparatus comprising:

waiting for a provision of electric power from a power source caused by a latching interaction of a first MOSFET and a second MOSFET triggered by one normally open switch of a plurality of switches being manually operated to be closed;

using a plurality of third transistors to decouple each of the switches from a low voltage terminal of the power source when the first MOSFET is in a conductive state; and latching the state of each switch of the plurality of switches and identifying a switch that was closed to trigger the latching interaction of the first and second MOSFETs.

6. The method of claim 5, wherein:

each switch of the plurality of switches is designated as a manually-operable control enabling a user of the apparatus to control an aspect of a function of the apparatus; and the method further comprises acting as indicated by a user having manually operated one of the switches identified as closed.

7. The method of claim 5, further comprising providing a low potential to a gate of the second MOSFET to place the second MOSFET into a non-conductive state to disrupt the latching interaction of the first and second MOSFETs.

* * * * *